US006953296B1

(12) United States Patent
Vora

(10) Patent No.: US 6,953,296 B1
(45) Date of Patent: Oct. 11, 2005

(54) MULTI-TIP MARKER

(76) Inventor: Ketan D. Vora, P.O. Box 323, Greenvale, NY (US) 11548

( * ) Notice: Subject to any disclaimer, the term of this patent is extended or adjusted under 35 U.S.C. 154(b) by 0 days.

(21) Appl. No.: 10/981,281

(22) Filed: Nov. 4, 2004

(51) Int. Cl.[7] ..... B43K 27/04
(52) U.S. Cl. ..... 401/35
(58) Field of Search ..... 401/28–36

(56) References Cited

U.S. PATENT DOCUMENTS

| | | | | |
|---|---|---|---|---|
| 3,887,287 A | * | 6/1975 | Rosh, Jr. | 401/35 |
| 4,580,918 A | | 4/1986 | Baker et al. | |
| 4,692,046 A | | 9/1987 | Lan | |
| 5,203,638 A | | 4/1993 | Redmond, Jr. | |
| 5,306,092 A | | 4/1994 | Jenq | |
| 5,388,924 A | | 2/1995 | Chao | |
| 5,549,403 A | * | 8/1996 | O'Shell | 401/31 |
| 5,971,643 A | | 10/1999 | Ahmed | |
| 6,155,733 A | | 12/2000 | Holbrook et al. | |
| D476,362 S | * | 6/2003 | Whitehorn | D19/36 |
| 6,685,373 B1 | * | 2/2004 | Liu | 401/35 |
| 2003/0016987 A1 | | 1/2003 | Ahmed | |

FOREIGN PATENT DOCUMENTS

| | | | | |
|---|---|---|---|---|
| DE | 3342648 A1 | * | 6/1985 | B43K 27/04 |
| DE | 3504262 A1 | * | 8/1986 | B43K 27/08 |
| DE | 3918373 A1 | * | 12/1990 | B43K 27/04 |

* cited by examiner

*Primary Examiner*—Justine R. Yu
*Assistant Examiner*—Huyen Le
(74) *Attorney, Agent, or Firm*—Richard L. Miller

(57) ABSTRACT

A multi-tip marker. Multiple tip cartridges are disposed in, and extend from, a housing. The housing contains a pair of orthogonal partitions that divide the housing internally into four chambers. Each tip cartridge includes a casing and a felt wick. The casing fits snugly in an associated chamber and is filled with ink. The felt wick extends in the casing and through the housing to form a tip.

10 Claims, 1 Drawing Sheet

MULTI-TIP MARKER

BACKGROUND OF THE INVENTION

1. Field of the Invention

The present invention relates to a marker. More particularly, the present invention relates to a multi-tip marker.

2. Description of the Prior Art

Numerous innovations for multi-tip writing instruments have been provided in the prior art that will be described. Even though these innovations may be suitable for the specific individual purposes to which they address, however, they differ from the present invention.

A FIRST EXAMPLE, U.S. Pat. No. 4,580,918 to Baker et al. teaches a writing instrument comprising a plurality of coaxial writing nibs and means for advancing and retracting the nibs relative to one another to adjust a selected nib into an operative writing position, whereby the instrument is adjustable to produce lines of different predetermined widths.

A SECOND EXAMPLE, U.S. Pat. No. 4,692,046 to Lan teaches a pen containing multi-color cores located in different tubes housed in the pen body, which colors can be optionally selected for use readily using a specially-designed turnable knob having a projected edge in cam contact with the top end of the core-receiving tubes. The top end of the core-receiving tube is pushed downward for use, when the turnable knob is rotated, so to enable a person to select a color core as he wishes quickly and readily.

A THIRD EXAMPLE, U.S. Pat. No. 5,203,638 to Redmond Jr. teaches a writing instrument that comprises a nonretractable nib 14 made of porous material and being in fluid communication with an ink reservoir of fluorescent transparent ink, the nib colloquially known as a "highlighter". A second nib is retractable and is substantially rigid and is in fluid communication with a second ink reservoir of nontransparent ink, the second nib colloquially known as a "ball point pen". The retractable and nonretractable nibs extend from an angular face of an elongated body in which they are contained. The angular face permits the nonretractable and retractable nibs, which are in parallel relation, to extend in spaced relations so that the retractable nib extends beyond the nonretractable nib whereby the nonretractable nib does not contact the writing surface when the retractable nib is used as a writing instrument. The extension and retraction of the retractable nib is accomplished with a slidable locking mechanism which allows a user to extend the retractable nib with a single finger motion without altering the writing angle or rotating the instrument in his hand, as in the prior art.

A FOURTH EXAMPLE, U.S. Pat. No. 5,306,092 to Jenq teaches a marking pen that is fabricated so that a twin-inserted head is inserted separately into different colored ink tubes, when the ink flows from the ink tubes to the head of the pen, the colors will mix naturally in the area adjacent to the middle of the bottom end on the head of the pen, so as to produce a gradually-layered color effect and create multi-color changes to the work produced without going through a color spray finishing process.

A FIFTH EXAMPLE, U.S. Pat. No. 5,388,924 to Chao teaches a drawing pen for drawing lines having different shades, including a plurality of ink reservoirs received within a barrel thereof, and a plurality of absorptive drawing tips respectively connected to the ink reservoirs at the bottom and disposed outside the barrel for drawing, wherein the absorptive drawing tips having adjacent surfaces are complementary and engaged to one another by a watertight bonding agent.

A SIXTH EXAMPLE, U.S. Pat. No. 5,971,643 to Ahmed teaches a marker apparatus for placing an elongate mark on a marking medium surface, including a first chamber having a first chamber proximal end, a first chamber distal end with a first chamber wick port, and containing a first pigmented marking liquid; a second chamber having a second chamber proximal end, a second chamber distal end with a second chamber wick port, and containing a second pigmented marking liquid; a first wick segment in liquid communication with the first pigmented marking liquid protruding from the first chamber wick port for contact with a surface of a marking medium; a second wick segment in liquid communication with the second pigmented marking liquid protruding from the second chamber wick port for contact with a surface of a marking medium; and a chamber retaining structure retaining the first chamber and the second chamber so that the first wick segment is positioned substantially adjacent to the second wick segment. The chamber retaining structure preferably includes an open-ended housing containing the first and second chambers. The first and second wick segments protrude from the housing opening.

A SEVENTH EXAMPLE, U.S. Pat. No. 6,155,733 to Holbrook et al. teaches a writing implement with three or more non-coaxial optionally selectable writing tips to produce lines of different thicknesses and to create unique and distinct "outlining" or "highlighting" effects. It is particularly adapted to be used on fibrous or felt tip type highlighter markers, but could be used on a variety of writing implements. The Meriting implement is comprised of a hollow low body supporting a fixed writing tip, a reservoir in the body holding a supply of ink, a series of two or more retractable tips slidably arranged alongside the fixed tip and adjusting means attached to each retractable tip to axially move each retracting tip to first and second operating positions, so that when moved to and locked in the first operative position, each retractable tip is extended with respect to the fixed tip, and when moved to and locked in the second operative position, each retractable tip is retracted with respect to the fixed tip. All tips are made of a porous material having capillary channels and being in fluid communication with the ink reservoir.

AN EIGHTH EXAMPLE, U.S. Patent Application Pub. No. 2003/0016987 A1 to Ahmed teaches a multicolor marker with a plurality of marking nibs that individually receive ink of different colors or shades. The nibs have marking surfaces that are elongated in one direction and can be selectively aligned end-to-end to produce a continuous line whose color changes from one nib to the next.

It is apparent that numerous innovations for multi-tip writing instruments have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a multi-tip marker that avoids the disadvantages of the prior art.

ANOTHER OBJECT of the present invention is to provide a multi-tip marker that is simple to use.

BRIEFLY STATED, STILL ANOTHER OBJECT of the present invention is to provide a multi-tip marker. Multiple tip cartridges are disposed in, and extend from, a housing. The housing contains a pair of orthogonal partitions that divide the housing internally into four chambers. Each tip cartridge includes a casing and a felt wick. The casing fits snugly in an associated chamber and is filled with ink. The felt wick extends in the casing and through the housing to form a tip.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
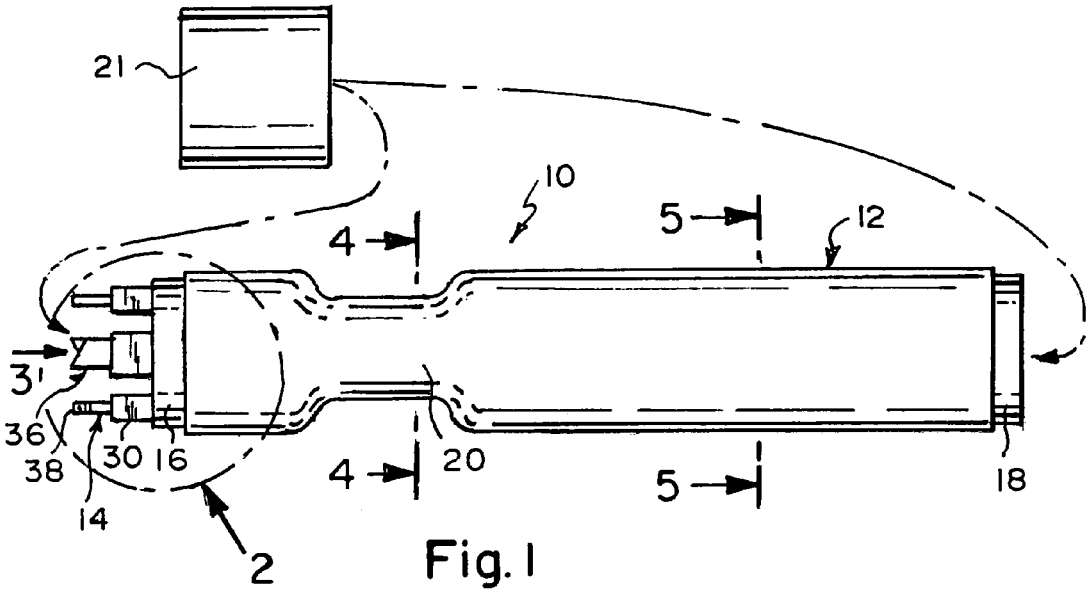
FIG. 1 is a partially exploded diagrammatic side elevational view of the multi-tip marker of the present invention.

10 multi-tip marker of present invention
12 housing
14 multiple tip cartridges
16 proximal end of housing 12
18 distal end of housing 12
20 neck of housing 12 for being captured by thumb and first finger of hand
21 cap
22 pair of orthogonal partitions 22 in housing 12
24 four chambers in housing 12
26 four through bores in proximal end 16 of housing 12
28 periphery of each through bore of four through bores 26 in proximal end 16 of housing 12
30 sleeve of periphery 28 of each through bore of four through bores
26 in proximal end 16 of housing 12
32 casing of each tip cartridge of multiple tip cartridges 14
34 ink of each tip cartridge of multiple tip cartridges 14
36 felt wick of each tip cartridge of multiple tip cartridges 14
38 tip of felt wick 36 of each tip cartridge of multiple tip cartridges 14.

DETAILED DESCRIPTION OF THE PREFERRED EMBODIMENT

Figure 2:
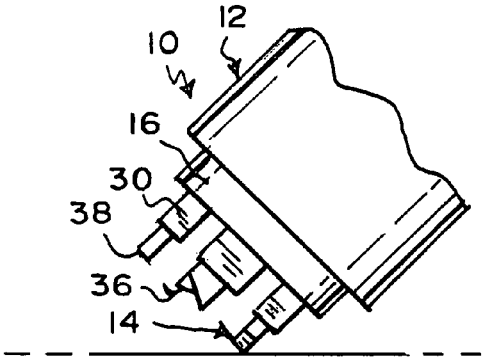
FIG. 2 is an enlarged diagrammatic side elevational view of the area generally enclosed by the dotted curve identified by ARROW 2 in FIG. 1 of the multi-tip marker of the present invention in use.

Referring now to the figures, in which like numerals indicate like parts, and particularly to FIGS. 1 and 2, which are, respectively, a partially exploded diagrammatic side elevational view of the multi-tip marker of the present invention, and an enlarged diagrammatic side elevational view of the area generally enclosed by the dotted curve identified by ARROW 2 in FIG. 1 of the multi-tip marker of the present invention in use, the multi-tip marker of the present invention is shown generally at 10.

The multi-tip marker 10 comprises a housing 12 and multiple tip cartridges 14. The multiple tip cartridges 14 are disposed in, and extend from, the housing 12.

The housing 12 is slender and elongated for fitting comfortably in a hand when in use.

The housing 12 has a proximal end 16, and a distal end 18, and a neck 20. The neck 20 of the housing 12 is intermediate the proximal end 16 of the housing 12 and the distal end 18 of the housing 12 and is for being captured by the thumb and first finger of the hand when in use. The proximal end 16 of the housing 12 is closed, the distal end 18 of the housing 12 is closed, and the neck 20 of the housing 12 is reduced.

The proximal end 16 of the housing 12 is reduced and the distal end 18 of the housing 12 is reduced to be selectively engaged in a cap 21.

Figure 3:
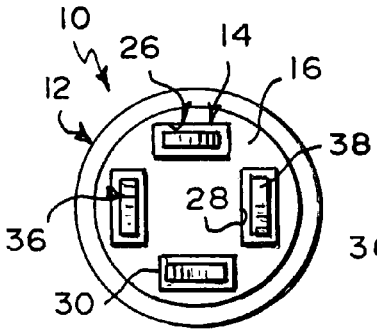
FIG. 3 is an enlarged diagrammatic front end view taken generally in the direction of ARROW 3 in FIG. 1.
Figure 4:
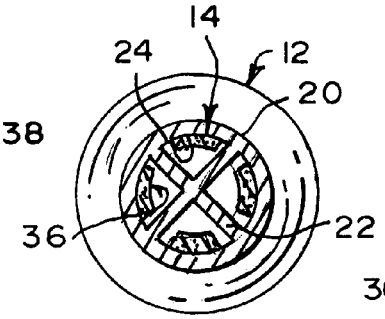
FIG. 4 is an enlarged diagrammatic cross sectional view taken along LINE 4—4 in FIG. 1.
Figure 5:
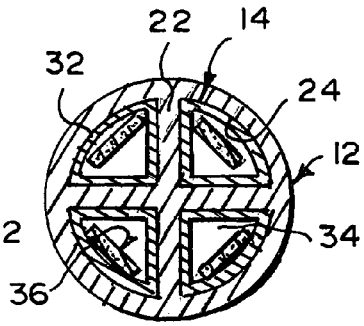
FIG. 5 is an enlarged diagrammatic cross sectional view taken along LINE 5—5 in FIG. 1.

The configuration of the multiple tip cartridges 14 and their relationship to the housing 12 can best be seen in FIGS. 3–5, which are, respectively, all enlarged diagrammatic front end view taken generally in the direction of ARROW 3 in FIG. 1, an enlarged diagrammatic cross sectional view taken along LINE 4—4 in FIG. 1, and an enlarged diagrammatic cross sectional view taken along LINE 5—5 in FIG. 1, and as such, will be discussed with reference thereto.

The housing 12 contains a pair of orthogonal partitions 22. The pair of orthogonal partitions 22 in the housing 22 extend from the proximal end 16 of the housing 12 to the distal end 18 of the housing 12 and divide the housing internally into four chambers 24.

The proximal end 16 of the housing 12 has four through bores 26. Each through bore 26 in the proximal end 16 of the housing 12 is defined by a periphery 28. The periphery 28 of each through bore 26 in the proximal end 16 of the housing 12 extends forwardly into a sleeve 30.

Each tip cartridge 14 comprises a casing 32. The casing 32 of each tip cartridge 14 fits snugly in an associated chamber 24 in the housing 12, from the distal end 18 of the housing 12 up to the neck 20 of the housing 12, and is filled with ink 34.

Each tip cartridge 14 further comprises a felt wick 36. The felt wick 36 of each tip cartridge 14 extends in the casing 32 of an associated tip cartridge 14, from the distal end 18 of the housing 12 through an associated sleeve 30 on the proximal end 16 of the housing 12 to form a tip 38 (FIG. 2).

The tip 38 of the felt wick 36 of each tip cartridge 14 is slanted (FIG. 2) for facilitating writing.

It will be understood that each of the elements described above, or two or more together, may also find a useful application in other types of constructions differing from the types described above.

While the invention has been illustrated and described as embodied in a multi-tip marker, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

I claim:

1. A multi-tip marker, comprising:

a) a housing; and b) multiple tip cartridges;

wherein said multiple tin cartridges are disposed in said housing; and wherein said multiple tip cartridges extend from said housing, wherein said housing has a proximal end;

wherein said housing has a distal end; and wherein said housing has a neck, wherein said housing contains a pair of orthogonal partitions, wherein said pair of orthogonal partitions in said housing extend from said proximal end of said housing to said distal end of said housing; and wherein said pair of orthogonal partitions in said housing divide said housing internally into four chambers, wherein said proximal end of said housing has four through bores; and wherein each through bore in said proximal en of said housing is defined by a periphery, wherein said periphery of each through bore in said proximal end of said housing extends forwardly into a sleeve, wherein each tip cartridge comprises a casing, wherein said casing of each tip cartridge fits snugly in an associated chamber in said housing; and wherein said casing of each tip cartridge extends from said distal end of said housing up to said neck of said housing.

2. The marker as defined in claim 1, wherein said housing is slender and elongated for fitting comfortably in a hand when in use.

3. The marker as defined in claim 1, wherein said neck of said housing is intermediate said proximal end of said housing and said distal end of said housing; and wherein said neck of said housing is for being captured by the thumb and first finger of a hand when in use.

4. The marker as defined in claim 1, wherein said proximal end of said housing is closed.

5. The marker as defined in claim 1, wherein said distal end of said housing is closed.

6. The marker as defined in claim 1, wherein said neck of said housing is reduced.

7. The marker as defined in claim 1, wherein said proximal end of said housing is reduced and said distal end of said housing is reduced to be selectively engaged in a cap.

8. A multi-tin marker, comprising:

a) housing; and b) multiple tip cartridges;

wherein said multiple tin cartridges are disposed in said housing; and wherein said multiple tip cartridges extend from said housing, wherein said housing has a proximal end;

wherein said housing has a distal end; and wherein said housing has a neck, wherein said housing contains a pair of orthogonal partitions, wherein said pair of orthogonal partitions in said housing extend from said proximal end of said housing to said distal end of said housing; and wherein said pair of orthogonal partitions in said housing divide said housing internally into four chambers, wherein said proximal end of said housing has four through bores; and wherein each through bore in said proximal end of said housing is defined by a periphery, wherein said periphery of each through bore in said proximal end of said housing extends forwardly into a sleeve, wherein each tip cartridge comprises a casing, wherein said casing of each tip cartridge is filled with ink.

9. A multi-tip marker, comprising:

a) a housing; and b) multiple tip cartridges;

wherein said multiple tin cartridges are disposed in said housing; and wherein said multiple tin cartridges extend from said housing, wherein said housing has a proximal end;

wherein said housing has a distal end; and wherein said housing has a neck, wherein said housing contains a pair of orthogonal partitions, wherein said pair of orthogonal partitions in said housing extend from said proximal end of said housing to said distal end of said housing; and wherein said pair of orthogonal partitions in said housing divide said housing internally into four chambers, wherein said proximal end of said housing has four through bores; and wherein each through bore in said proximal end of said housing is defined by a periphery wherein said periphery of each through bore in said proximal end of said housing extends forwardly into a sleeve, wherein each tip cartridge comprises a casing, wherein each tip cartridge comprises a felt wick, wherein said felt wick of each tip cartridge extends in said casing of an associated tip cartridge; and wherein said felt wick of each tip cartridge extends from said distal end of said housing through an associated sleeve on said proximal end of said housing to form a tip.

10. The marker as defined in claim 9, wherein said tip of said felt wick of each tip cartridge is slanted for facilitating writing.

* * * * *